US005472832A

United States Patent [19]

Timmerman et al.

[11] Patent Number: 5,472,832

[45] Date of Patent: Dec. 5, 1995

[54] SILVER HALIDE PHOTOGRAPHIC ELEMENT CONTAINING ANTISTATIC HYDROPHILIC COLLOID BINDER LAYER

[75] Inventors: Daniel M. Timmerman, Mortsel; Filip B. E. Byl, Oostkamp; Frank G. De Voeght, Heist-op-den Berg, all of Belgium

[73] Assignee: AGFA-Gevaert, N.V., Mortsel, Belgium

[21] Appl. No.: 69,675

[22] Filed: Jun. 1, 1993

Related U.S. Application Data

[63] Continuation of Ser. No. 951,048, Sep. 24, 1992, abandoned, which is a continuation of Ser. No. 682,384, Apr. 9, 1991, abandoned.

[30] Foreign Application Priority Data

Apr. 19, 1990 [EP] European Pat. Off. ..... 90200967

[51] Int. Cl.$^6$ ..... G03C 1/85

[52] U.S. Cl. ..... 430/510; 430/527; 430/529

[58] Field of Search ..... 430/527, 529, 430/510

[56] References Cited

U.S. PATENT DOCUMENTS 4,287,298 9/1981 Dodwell ..... 430/529

4,301,240 11/1981 Bruck et al. ..... 430/527

4,940,655 7/1990 Gundlach ..... 430/527

5,268,253 12/1993 Van Rompuy ..... 430/204

*Primary Examiner*—Richard L. Schilling

*Assistant Examiner*—Christopher G. Young

*Attorney, Agent, or Firm*—Breiner & Breiner

[57] ABSTRACT

A recording material comprising a sheet, ribbon or web support and a hydrophilic colloid binder layer incorporating an ionic polymer in the form of dispersed particulate material providing to said material an antistatic character, characterized in that (i) said ionic polymer is a cross-linked copolymer of an acrylic and/or methacrylic acid ester including 90–99 mole % of acrylate and/or methacrylate and 1 to 10 mole % of tetraallyloxyethane as polyfunctional crosslinking monomer, wherein in said copolymer at least 75% of the ester groups have been transformed into alkali metal carboxylate groups (ii) said ionic polymer is coated at a coverage of at least 14 g/m$^2$, and (iii) said ionic polymer is present in admixture with said hydrophilic colloid binder in a weight ratio of at least 10/90.

12 Claims, No Drawings

SILVER HALIDE PHOTOGRAPHIC ELEMENT CONTAINING ANTISTATIC HYDROPHILIC COLLOID BINDER LAYER

This is a continuation of application Ser. No. 07/951,048 filed on Sep. 24, 1992, now abandoned; which, in turn, is a continuation of Ser. No. 07/682,384 filed on Apr. 9, 1991, now abandoned.

FIELD OF THE INVENTION

The invention is concerned with recording materials wherein a sheet, ribbon or web carries an antistatic layer.

BACKGROUND OF THE INVENTION

It is known that resin films or resin coated papers of low conductivity become electrostatically charged by friction with dielectric materials and/or contact with electrostatically chargeable transport means, e.g. rollers. The charging occurs particularly easily in a relatively dry atmospheric environment.

Sheets, ribbons and webs made of hydrophobic resin or coated with such resin, e.g. a polyester resin or cellulose triacetate, are commonly used as base materials or supports in recording materials. Such supports are subjected to frictional contact with other elements during the manufacture of the recording materials, e.g. during a coating or cutting stage, and during use, e.g. during the recording of information or (in the case of silver halide photographic materials) during image-processing or projection. Especially in the reeling-up or unfeeling of dry photographic film in a camera or projector high friction may build up, resulting in electrostatic charges that may attract dust or cause sparking. In unprocessed photographic silver halide emulsion materials sparking causes undesirable exposure marks and degrades the image quality.

In order to reduce electrostatic charging of sheets or webs comprising a hydrophobic resin layer or support without impairing their transparency it is known to apply coatings which are formed of or incorporate ionic compounds such as antistatic high molecular weight polymeric compounds having ionic groups at frequent intervals in the polymer chain [ref. e.g. Photographic Emulsion Chemistry, by G. F. Duffin, —The Focal Press—London (1966)—Focal Press Limited,. p. 168, and U.S. Pat. No. 4,301,240]. Examples of polymers that have been used for this purpose include salts of polyacrylic acid, of polystyrene sulphonic acid and copolymers which contain quaternary ammonium groups.

Ionic polymers containing protonated or quaternized amino groups, although being good antistatic agents are often useless in photographic silver halide emulsion materials because of their too high a solubility in water and their fogging activity.

In U.S. Pat. No. 4,301,240 a photographic material is described wherein for the purpose of improving mechanical and electrostatic properties a cross-linked particulate acrylic or methacrylic polymer salt is used in hydrophilic colloid layers such as a gelatin-silver halide emulsion layer or light insensitive gelatin containing layer of a photographic silver halide emulsion layer material.

The advantages of the use of said particulate polymer salts, which are applied as a dispersion (latex), follow from their resistance to diffusion, low swelling power and their property of not influencing the viscosity of gelatinous coating compositions. Said particulate polymer salts remain by their insolubility resistant to diffusion in hydrophilic colloid layers under the conditions of changing pH, e.g. in photographic processing baths.

It has been found experimentally by us that especially the alkaline metal salts of said crosslinked polymers improve the electrical conductivity of a hydrophilic colloid layer but that the corresponding polyvalent metal ion salts, particularly the alkaline earth metal salts and aluminium salts are harmful for that purpose.

Since water washing or rinsing of developed and fixed photographic silver halide emulsion materials proceeds in most cases with natural water containing calcium and magnesium ions stemming from the soil from which tap water is extracted there is a high risk of decreasing the conductivity and consequently of reducing the antistatic character by ion exchange of alkali metal ions of said cross-linked polymer for polyvalent metal ions such as calcium and magnesium ions.

SUMMARY OF THE INVENTION

It is an object of the present invention to provide a recording material including a sheet, ribbon or web support and a hydrophilic colloid binder layer incorporating an ionic polymer in the form of a dispersion which polymer improves the electrical conductivity of said material.

It is a particular object of the present invention to provide a photographic silver halide emulsion sheet, ribbon or web material coated with a hydrophilic colloid binder layer incorporating an ionic polymer in the form of a dispersion which polymer applied at a certain coverage and weight ratio with respect to the hydrophilic colloid binder makes that the developed and fixed photographic silver halide emulsion material can be rinsed with "hard" water without substantially impairing the antistatic character of said layer.

Other objects and advantages of the present invention will appear from the further description and examples.

According to the present invention there is provided a recording material comprising a sheet, ribbon or web support and a hydrophilic colloid binder layer incorporating an ionic polymer in the form of dispersed particulate material providing to said material an antistatic character, characterized in that (i) said ionic polymer is a cross-linked copolymer of an acrylic and/or mathacrylic acid ester including 90–99 mole % of acrylate and/or methacrylate and 1 to 10 mole % of tetraallyloxyethane as polyfunctional crosslinking monomer, wherein in said copolymer at least 75% of the ester groups have been transformed into alkali metal carboxylate groups, (ii) said ionic polymer is coated at a coverage of at least 1.4 g/m$^2$, and (iii) said ionic polymer is present in admixture with said hydrophilic colloid binder in a weight ratio of at least 10/90.

The electrical conductivity of the antistatic layer increases directly proportionally to the coverage of said ionic cross-linked copolymer, the upper value of the coverage being limited by physical properties other than electrical conductivity of the antistatic layer. For example, a silver halide emulsion film comprising an outermost antistatic layer incorporating more than 3 g/m$^2$ of said cross-linked copolymer has a hazy appearance, too low a scratch resistance, too high a water adsorptivity, and shows poor dimensional stability, so that for application in silver halide films the coverage is kept preferably below that value.

By the presence of said ionic cross-linked copolymer in a coverage of at least 2.2 g per m$^2$ and weight ratio of 50/50 with respect to the hydrophilic colloid binder of said antistatic layer a photographic silver halide emulsion material including such antistatic layer as outermost layer remains on conditioning at a relative humidity of 30% sufficiently electrically conductive for preventing dust attraction even when having been treated with an alkaline developing liquid, an acidic (pH not lower than 5.0) fixing stop bath and rinsing water having a total hardness equivalent with 350 parts of calcium carbonate per million of water, the rinsing lasting no longer than i minute at a temperature in the range of 18° to 35° C.

Said ionic cross-linked copolymer being a latex-copolymer is perfectly compatible with gelatin causing no flocculation, matting or viscosity increase.

DETAILED DESCRIPTION OF THE INVENTION

The ionic cross-linked copolymers used according to the present invention are prepared analogously to the method described in U.S. Pat. No. 4,301,240 by emulsion polymerisation of aliphatic esters of acrylic and/or mathacrylic acid in water in the presence of polyfunctional cross-linking monomers and an emulsifier, followed by saponification of the obtained copolymer. By said emulsion polymerisation copolymers with a molecular weight well above 500,000 are obtained and the average particle size of the latex is smaller than 150 nm.

In order to illustrate the synthesis of ionic cross-linked copolymers useful as antistatic agent in hydrophilic colloid coatings of a recording material according to the present invention the following preparations I and II are given hereinafter in detail.

Preparation I relates to the production of the acrylate ester copolymer and Preparation II relates to the partial saponification of said acrylate copolymer to a corresponding potassium salt.

Preparations III and IV are given for comparative test purposes and relate to the production of calcium and magnesium salts of a cross-linked copolymer.

Preparations I & II

I. Poly([c.1.]tetraallyloxyethane-co-methyl acrylate) (3/97 molar ratio)

In a 300 l glass lined reaction vessel provided with reflux condenser, two inlet openings and hot water heating jacket were introduced at moderate stirring 900 g of DOWFAX 2A1 (trade name of DOW Chemicals for a mixture of dodecylated oxydibenzene disodium sulfonate and disulfonated dodecyl diphenyloxide being emulsifying agents) dissolved in 159 1 of demineralized water.

Before introduction into the reaction vessel 41.2 kg (479 mole) of methyl acrylate were thoroughly mixed with 3.77 kg (14.8 mole) of distilled tetraallyloxyethane.

Likewise before introduction into the reaction vessel an initiator solution was prepared separately by dissolving 225 g of potassium persulphate in 16 1 of demineralized water.

At a reaction temperature in the range of 70° to 75° C. 1/10th of the available monomer mixture and 1/10th of the initiator solution were introduced with rapid stirring into the emulsifier solution over a period of 5 to 10 minutes.

In the course of the following 15 minutes a slightly exothermic reaction was noticed and the remaining monomer mixture and initiator solution was added gradually over a period of 1 h whereby the reaction temperature reached a maximum of 88° C. and a regular reflux of methyl acrylate was obtained. After completion of the introduction of monomer mixture and initiator solution stirring was continued for 1 h while the reaction temperature dropped to about 80° C. Then the reaction mixture was cooled down to 25°–30° C.

About 220 kg of latex were obtained containing 21 g of cross-linked copolymer in 100 g of dispersion. The latex particles had an average particle size of 90–130 nm. The pH of the latex was in the range of 2.5 to 3 and the viscosity was 2.5 mPa.s at 25° C.

II. Poly([c.1.]tetraallyloxyethane-co-methyl acrylate/potassium acrylate) (3/18/79 molar ratio)

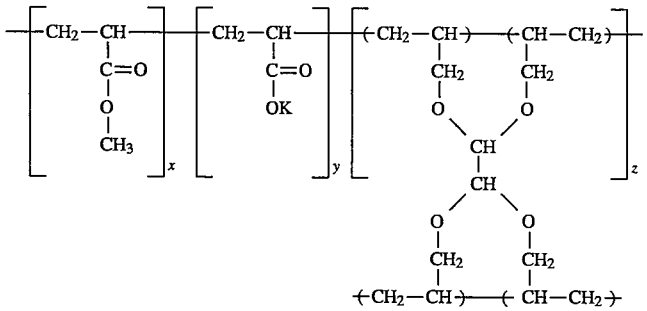

x = 18 mole %
y = 79 mole %
z = 3 mole %

In a 80 1 stainless steel reaction vessel provided with reflux condenser and addition funnel of 20 liter 37.9 kg of the above prepared latex (containing about 7.94 kg of copolymer comprising about 85 mole of polymerized methyl acrylate) and 18.9 1 of demineralized water were introduced and slowly heated to 95° C. Then 5.62 kg of potassium hydroxide (85% wt) was dissolved in 18.9 1 of demineralized water and added over a period of 30 minutes. During the introduction of the potassium hydroxide solution the temperature of the saponification mixture was kept at about 95° C. and by carefully controlled heating a weak reflux of methanol was maintained hereby avoiding foaming.

The saponification mixture was boiled for a further 8 h having the boiling point dropping from 100° C. to 98° C. After cooling the reaction mixture was filtered through a qualitative fast speed filter paper.

The filtrate was neutralized to pH 7.0 by adding the necessary quantity of ion exchange resin LEWATIT S 100 (trade name of BAYER A.G. for a sulfonated styrene divinylbenzene copolymer in acidic form). After removing the ion exchange resin by filtering through filter cloth and by adding an adequate amount of demineralized water a latex containing 10% by weigth of the above defined copolymer was obtained.

1.0 kg of a latex containing 10% by weight of poly([c.1.] tetraallyloxyethane-co-methyl acrylate/acrylic acid partly potassium salt) contains in said polymer 64.9 g (0.59 mole) of potassium acrylate units and 14.18 g (0.197 mole) of acrylic acid units. Said copolymer is identified furtheron as the $K^+$-polymer.

Preparation III

A) 1.0 kg of a latex (average particle size: 120 nm) containing 13.95% by weight of poly([c.1.]tetraallyloxyethane-co-methyl acrylate/acrylic acid, partly potassium salt) having 90.59 g (0.8235 mole) of potassium acrylate units and 19.76 g (0.274 mole) of acrylic acid units was diluted with demineralized water up to 1.5 liters. The diluted latex was put dropwise through a 3 1 ion-exchange column containing in acidic form the ion-exchange resin LEWATIT S 100 (trade name). The passage lasted 2 h whereupon the column was rinsed with 2.5 1 of demineralized water.

In a rotary-evaporator operating under vacuum at 30° C. the thus obtained diluted polymer dispersion having a pH of about 1 was concentrated to 600 g. The concentrated dispersion contained 17.98% by weight of poly([c.1.]tetraallyloxyethane-co-methyl acrylate/acrylic acid).

B) 54.54 grams of the above prepared acidic polymer dispersion were diluted with 40 ml of demineralized water in a 250 ml flask provided with a reflux condenser, a hot water heating jacket and a temperature and stirring control unit.

At a temperature of 50° C., $Ca(OH)_2$ was introduced gradually until the pH reached a value of 9. The stirring was continued for 1 hour at 50° C. A Ca-salt copolymer dispersion was obtained. After cooling the reaction product was filtered and rinsed with demineralised water.

100 g of diluted dispersion (pH=9.0) contained the transformed copolymer (identified in the text as the $Ca^{2+}$-polymer) including 0.05 mole of calcium acrylate units.

Preparation IV

In accordance with the above described synthesis of the $Ca^{2+}$-polymer the Mg-salt was obtained through the addition of 2.0 g (0.05 mole) of MgO to 54.54 g of the acidic copolymer dispersion as described in part A of preparation III.

100 g of diluted dispersion (pH=9.0) contained the transformed copolymer (identified in the text as the $Mg^{2+}$-polymer) including 0.05 mole of magnesium acrylate units.

Hydrophilic colloid binders that can be homogeneously mixed with said cross-linked ionic latex-type copolymer are e.g. proteinaceous colloids, e.g. gelatin, polysaccharide, polyvinyl alcohol, polyacrylamides and poly-N-vinylpyrrolidinone. The use of mixtures of said hydrophilic colloids is not excluded. Among these binders the most preferred is gelatin.

According to a preferred embodiment the ionic cross-linked copolymer as defined above is applied for production of an antistatic coating in the weight ratio range of 70/30 to 80/20 with respect to gelatin.

The surface resistance expressed in ohm/square (ohm/sq.) is measured by a test proceeding as follows:

after coating the resulting antistatic layer is dried and conditioned at a specific relative humidity. The surface resistance measurement is performed by placing two conductive copper poles having a length of 10 cm parallel to each other at a distance of 1 cm and measuring the resistance built up between said electrodes with a precision ohm-meter. By multiplying the thus determined ohm value with the factor 10 the surface resistance value expressed as ohm/square (ohm/sq) is obtained.

The coating of the antistatic layer ingredients on a resin support or resin-coated paper support may proceed by any coating technique known in the art for applying gelatin coatings, e.g. by doctor blade coating, air knife coating, curtain coating, slide hopper coating or meniscus coating, which are coating techniques known from the production of photographic silver emulsion layer materials.

In the coating composition of the antistatic layer may be present also other ingredients such as ionic and non-ionic surfactants, e.g. polyoxyethylene compounds improving conductivity, wetting agents as coating aid, e.g. perfluorinated surfactants, matting agents, pigments, and dyes.

A web or sheet according to the invention can incorporate more than one antistatic layer, each incorporating the crosslinked latex-type copolymer as herein defined. For example there may be one such antistatic layer on each side of the hydrophobic resin support or resin-coated paper. In that way a particularly high resistance to dust attraction and sparking can be achieved.

According to an embodiment said antistatic coating is applied as an outermost coating, e.g. as protective layer at the silver halide emulsion layer side of a photographic silver halide emulsion layer material.

According to a preferred embodiment said antistatic layer is applied as a back layer, i.e. at the side of the support opposite the silver halide emulsion layer(s).

According to an other embodiment said antistatic layer is applied as a stratum between the support and a silver halide emulsion layer or silver halide emulsion layer assembly.

According to a preferred embodiment the antistatic layer is covered with a protective layer, e.g. on the basis of hardened gelatin. The presence of the hardened protective layer hinders the penetration of calcium and magnesium salts and greatly prevents the degrading of the antistatic properties of the underlying antistatic layer. As is known to those skilled in the art examples of suitable hardeners include aldehyde hardeners, e.g. formaldehyde, N-methylol compounds, quinones, carboxylic acid and carbamic acid derivates, sulfonate esters and sulfonyl halides, halogen compounds, epoxides, aziridines, olefines, isocyanates, carbodiimides, isoxazolium salts and vinylsulfonyl compounds as described e.g. in U.S. Pat. No. 4,845,024 and U.S. Pat. No. 4,894,324. A preferred vinylsulfonyl compound is $CH_2{=}CH{-}SO_2{-}CH_2{-}SO_2{-}CH{=}CH_2$. A survey of suitable hardeners is given e.g. in "The Theory of the Photografic Process" by T. H. James (Macmillan Publ. Co.), 1977, p. 79–84.

A preferred protective layer is made from gelatin hardened up to a degree corresponding with the addition of 0.03 g of formaldehyde per gram of gelatin. The gelatin coverage in the protective layer is preferably not higher than 3 g per $m^2$ and is more preferably in the range of 1 to 2 g per $m^2$.

In admixture with the hardened gelatin the protective layer may contain Friction-lowering substance(s) such as dispersed wax particles (carnaubawax or montanwax) or polyethylene particles, fluorinated polymer particles, silicon polymer particles and/or calcium complexing agents.

According to a special embodiment the friction lowering substance(s) are present in the antistatic layer serving as outermost layer.

The sticking power or the antistatic layer especially in wet state, is reduced considerably by incorporating therein silicone polymers or fluorinated polymers.

A common support of a photographic silver halide emulsion material is a hydrophobic resin support or hydrophobic resin coated paper support. Hydrophobic resin supports are well known to those skilled in the art and are made e.g. of polyester, polystyrene, polyvinyl chloride, polycarbonate, preference being given to polyethylene terephthalate. A preferred resin coated paper support is a poly-Alpha-olefin coated paper support such as a polyethylene coated paper support.

The hydrophobic resin support may be provided with one or more subbing layers known to those skilled in the art for adhering thereto a hydrophilic colloid layer. Suitable subbing layers for polyethylene terephthalate supports are described e.g. in U.S. Pat. No. 3,397,988, 3,649,336, 4,123,278 and 4,478,907.

Polyester films such as polyethylene terephthalate films are manufactured normally by a process wherein the films are molecularly oriented by stretching in two mutually perpendicular directions. The process is conveniently accomplished by sequentially stretching a flat amorphous polyester film first in one direction and then in another direction perpendicular thereto. Generally, the Film is stretched first in the longitudinal direction, i.e. in the direction of passage through the stretching machine, and then in the transverse direction. The stretched films may also be dimensionally stabilised by heat-setting under dimensional restraint. Stretching and heat setting is conventionally carried out by heating the film above ambient temperature.

On using a stretchable resin support, e.g. polyethylene terephthalate resin support, the coating from aqueous medium of the ionic cross-linked copolymer dispersed in dissolved hydrophilic colloid binder is applied preferably on such support after longitudinal and transverse stretching. Said stretching is carried out normally in the temperature range of 80° to 100° C. The stretched film is normally heat-set by heating in the range of 180° to 200° C. for 0.1 to 2 minutes while it is retained from shrinkage.

According to a particular embodiment the above defined antistatic layer is used in combination with colloidal silica or a colloidal silica layer as described e.g. in U.S. Pat. No. 3,525,621 and published European patent application 0 334 400 A1.

For the composition of silver halide emulsion layers whereto said antistatic layer may be applied reference is made e.g. to Research Disclosure 17,643 of December 1978, and Research Disclosure 307,105 of November 1989.

Photographic silver halide emulsion materials containing an antistatic layer according to the present invention may be of any type known to those skilled in the art. For example, the antistatic layer is useful in continuous tone or halftone photography, microphotography and radiography, in black-and-white as well as colour photographic materials.

In a particular embodiment of the present invention a silver halide photographic material is used that is provided at the rear side of the support (the side opposite the light-sensitive layer(s)) with an antihalation coating containing one or more pigments in admixture with a binder and the antistatic layer is applied thereon or between the support and the antihalation coating. The antireflection substance used in the antihalation coating, e.g. carbon black, may itself have antistatic properties. According to another embodiment the antistatic layer is dyed with an antihalation dye that can be removed in the processing, e.g. by alkaline treatment or by a solvent or solvent mixture.

Apart from its use in photosensitive silver halide emulsion materials the above defined antistatic layer may be present in a non-photosensitive material serving as image-receiving material in the silver complex diffusion transfer process or in a dye diffusion transfer process as described e.g. in Angew. Chem. Int. Ed. Engl. 22, (1983) p. 191–209.

The present antistatic layer is useful likewise in reducing surface resistance of non-photosensitive mounting or drafting film.

By using a recording material having an antistatic layer according to the present invention the problems caused by static charges prior to and after wet processing can be avoided or substantially reduced. Such means for example that the formation of static charges by contact of a silver halide emulsion layer side with the rear side of the recording material or caused by friction with substances such as rubber and hydrophobic polymeric binder, e.g. the binder constituent of phosphor screens used as X-ray intensifying screens, can be markedly reduced by employing the present antistatic layer. The building up of static charges and subsequent dust attraction and/or sparking, e.g. during loading of films in cassettes, e.g. X-ray cassettes, or in cameras, or during the taking or projection of a sequence of pictures as occurs in automatic cameras or film projectors is prevented.

The examples hereinafter set forth are directed to the use of an antistatic layer in combination with a polyethylene terephthalate resin support but other resin bases, e.g. made of polystyrene, polyvinyl chloride, cellulose ester such as cellulose triacetate, or polyethylene either or not treated by corona-discharge and/or subbed with (a) subbing layer(s) for improving the adherence of hydrophilic colloid layers will obtain a strong reduction in surface resistance when coated with the herein described antistatic layer.

The following examples illustrate the present invention without however limiting it thereto.

All percentages and ratios are by weight unless otherwise mentioned.

EXAMPLE 1 (COMPARATIVE EXAMPLE)

Each of the defined $K^+$-polymer, $Ca^{2+}$-polymer and $Mg^{2+}$-polymer dispersions were mixed with an aqueous gelatin solution. To 100 ml of each gelatin/polymer dispersion containing 3 g of gelatin and 7 g of the defined polymer were added 2 ml of a 5.0% aqueous solution of 7-ethyl- 2-methyl-4-undecanol sulfuric acid ester monosodium salt acting as wetting agent and 9.1 ml of an aqueous 5.1% 2,6-dichloro-s-triazine- 4-borate ester monosodium salt for hardening the gelatin. The pH of each coating composition was adjusted to 7 with hydrochloric acid. The gelatin/polymer dispersions were then coated independently onto separate 175 μm thick subbed polyethylene terephthalate (PET) film strips.

For each strip the coating proceeded with doctor blade at a wet coating thickness of 175 μm while the PET made contact with a coating plate heated internally with water at 40° C. The polymer to gelatin ratio in the thus obtained coated samples was 70/30.

The coated layers were set by chilling the plate with cold water (about 5 minutes) and thereupon the materials were put for 1 h in a ventilated drying cabinet at 30° C. and a relative humidity (R.V.) of 60%.

The thus conditioned samples were subjected to a further treatment of 3 days at 30% R.V. and 57° C. in order to complete the hardening of the gelatin binder of the coatings.

Of these three samples the surface resistance was determined as described hereinbefore and the obtained results for sample i containing the $K^+$-polymer, sample 2 containing the $Ca^+$-polymer and sample 3 containing the $Mg^+$-polymer were respectively 0.20, 5600 and 5500 $10^{10}$×ohm/square. From this it is clear that the calcium and magnesium salts are very poor conductors in comparison with the potassium salt.

EXAMPLE 2 (COMPARATIVE EXAMPLE)

For comparative test purposes a series of polymer dispersions containing the already mentioned $K^+$-polymer in admixture with gelatin in a particular ratio (P/G see Table 1) were prepared. These dispersions were coated at one side of a double side subbed 175 μm thick polyethylene terephthalate film support forming samples at a coverage of $K^+$-polymer (COV P in g per $m^2$) as indicated in the following Table 1. The coated layers of the thus obtained samples were subjected after drying to a photographic processing for silver halide emulsion film materials.

The processing included a development treatment lasting 14 s at 38° C., a rinsing treatment of 14 s at 35° C., an acid-fixing liquid (pH= 5.3) treatment of 14 s at 35° C., and again a rinsing treatment (twice 14 s) at 35° C. The rinsing treatments proceeded with tap water having a total hardness corresponding with 336 parts of calcium carbonate per million of water.

The thus processed samples were dried at 55° C. for 14 s and were subjected before measuring the surface resistance as defined herein to a 2 h conditioning at 30° C. and 30% R.V.

In Table 1 the surface resistance (ohm/sq) is expressed as e logarithmic value.

TABLE 1

| Sample No. | COV P g/$m^2$ | P/G | Surface resistance as log (ohm/sq) (30° C./30% R.V.) |
|---|---|---|---|
| 1 | 4.5 | 90/10 | 10.93 |
| 2 | 4.0 | 80/20 | 10.99 |
| 3 | 3.6 | 90/10 | 11.11 |
| 4 | 3.5 | 70/30 | 11.34 |
| 5 | 3.2 | 80/20 | 11.18 |
| 6 | 2.8 | 70/30 | 11.53 |
| 7 | 2.4 | 70/30 | 11.45 |
| 8 | 2.2 | 50/50 | 11.35 |
| 9 | 2.1 | 70/30 | 11.95 |
| 10 | 1.8 | 90/10 | 11.85 |
| 11 | 1.6 | 80/20 | 12.11 |
| 12 | 1.4 | 10/90 | 12.50 |
| 13 | 1.4 | 70/30 | 12.22 |
| 14 | 0.9 | 90/10 | 13.51 |
| 15 | 0.8 | 80/20 | 13.45 |
| 16 | 0.7 | 70/30 | 14.00 |

According to other embodiments on top of the antistatic layer of the above test samples 10, 11 and 12 a hardened gelatin layer was coated at a coverage of 2 g per $m^2$. The hardening of the gelatin covering layer proceeded by mixing the gelatin coating solution before coating with 0.9 ml of a 5.1% aqueous solution of 2,6-dichloro-s-triazine-4-borate ester monosodium salt per g of gelatin. The thus obtained samples 10', 11' and 12' were dried and processed as defined above. The processed and dried samples were conditioned for 24 h at 30° C. and 30% R.V. and their surface resistance was measured as defined above.

The obtained results are listed in the following Table 2.

TABLE 2

| Sample No. | COV P g/$m^2$ | P/G | Surface resistance as log (ohm/sq) (30° C./30% R.V.) |
|---|---|---|---|
| 10' | 1.8 | 90/10 | 10.90 |
| 11' | 1.6 | 80/20 | 11.08 |
| 12' | 1.4 | 70/30 | 11.40 |

The processed substrates were additionally subjected to a dust attraction test at 25° C. and 30% R.V. Therefor they were placed with their silver halide emulsion layer down onto a glass plate and rubbed at the antistatic layer side with a woollen cloth. Following said rubbing ashes of a cigarette were cascaded over the tilted surface. In this way a direct visualisation of the antistatic properties of the modified film was obtained. No dust was retained by electrostatic attraction on the samples 1 to 8 whereas the samples 9 to 16 retained increasing amounts of dust on the rubbed film side. The presence of the hardened protective layer in the samples 10', 11' and 12' hinders the penetration of calcium and magnesium salts and greatly prevents the degrading of the antistatic properties of the underlying antistatic layer. As can be deduced from said experimental results particularly good antistatic properties of the modified substrates are correlated with a surface resistance (ohm/sq), expressed as a logarithmic value, not higher than 11.5 (at 30° C. and 30% R.V.).

EXAMPLE 3 (COMPARATIVE EXAMPLE)

For comparative test purposes a photographic silver halide emulsion material was produced by coating onto one side of a double side subbed 100 um thick polyethylene terephthalate support a silver chlorobromide emulsion (2 mole % bromide—average grain size: 0.13 um) having a gelatin to silver halide ratio equivalent with 2.7 g of gelatin per 4.5 g of silver nitrate used in the production.

At the side of the support opposite the silver halide emulsion layer first a pre-coat of gelatin at a coverage of 0.6 g per $m^2$ was applied. Thereto a polymer dispersion containing the already mentioned $K^+$-polymer in admixture with gelatin in a 73/27 ratio was applied at a polymer coverage of 1.6 g per $m^2$. Onto the dried polymer dispersion coating a hardened gelatin covering layer was applied at a gelatin coverage of 1.85 g per $m^2$. The hardening proceeded by adding 0.03 grams of formaldehyde per gram of gelatin.

A strip of the thus coated and dried photographic material was divided into two equal parts A and B. Each part was processed with the same photographic liquids at 20° C. except for the composition of the rinsing liquid.

The processing consisted in subsequent order of: 20 s development in a common hydroquinone type developer at pH: 10.5, 20 s fixing in an acid (pH: 5.3) thiosulfate fixer and 20 s rinsing.

Part A was rinsed with tap water having a total hardness correponding with 336 parts of calcium carbonate per million of water, and part B was rinsed for the same duration with demineralized water.

The thus processed samples A and B were dried at 55° C. for 14 s and were subjected before measuring the surface resistance as defined herein to a 2 h conditioning at 30° C. and 30% R.V.

The surface resistance (ohm/sqm) expressed as a logarithm were for the samples A and B 10.86 and 10.08 respectively.

The samples A and B were subjected to a dust attraction test at 30% R.V. and 25° C. as described in Example 2. No dust was retained by electrostatic attraction on both the samples A and B.

We claim:

1. A photographic element containing a silver halide emulsion layer on a sheet, ribbon or web support, wherein said element contains an antistatic hydrophilic colloid binder layer incorporating at a coverage of at least 1.4 g/m$^2$ an ionic copolymer in a weight ratio of 10/90 with respect to said hydrophilic colloid binder, and wherein said ionic copolymer is obtained by saponification from a crosslinked copolymer being an acrylic or methacrylic acid ester copolymer consisting of 90–99 mole % of acrylate or methacrylate ester units crosslinked by 1 to 10 mole % of tetraallyloxyethane units, said saponification having resulted in the transformation of at least 75% of said ester units into alkali metal carboxylate groups.

2. A photographic element according to claim 1, wherein said alkali metal carboxylate groups are potassium carboxylate groups.

3. A photographic element according to claim 1, wherein said hydrophilic colloid binder is gelatin.

4. A photographic element according to claim 1, wherein said ionic polymer is coated at a coverage in the range of 1.4 to 3 g/m$^2$.

5. A photographic element according to claim 1, wherein said binder layer contains said ionic polymer coated at a coverage of 2.2 g/m$^2$.

6. A photographic element according to claim 1, wherein said antistatic layer is applied as an outermost layer.

7. A photographic element according to claim 6, wherein said antistatic outermost layer contains friction-lowering substances.

8. A photographic element according to claim 7, wherein said antistatic outermost layer is present on an antihalation coating.

9. A photographic element according to claim 1, wherein said antistatic layer is covered with a protective layer on the basis of hardened gelatin.

10. A photographic element according to claim 9, wherein said gelatin is hardened up to a degree corresponding with the addition of 0.03 g of formaldehyde per gram of gelatin.

11. A photographic element according to claim 9, wherein the gelatin is present in said protective layer at a coverage up to 3 g per m$^2$.

12. A photographic element according to claim 1, wherein said photographic element comprises one or more light-sensitive silver halide emulsion layers and said antistatic layer is present:

as outermost layer at the silver halide emulsion layer side of said photographic silver halide emulsion layer material, and/or as a back layer at the side of the support opposite the silver halide emulsion layer(s) of said photographic silver halide emulsion layer material, and/or as a stratum between the support and a silver halide emulsion layer or a silver halide emulsion layer assembly of said photographic silver halide emulsion layer material.

* * * * *